US006880872B2

(12) United States Patent
Eller et al.

(10) Patent No.: US 6,880,872 B2
(45) Date of Patent: Apr. 19, 2005

(54) LEVER HANDLE RETURN SPRING ASSEMBLY

(75) Inventors: Darren C. Eller, East Lyme, CT (US); Daniel Seymour, Plainville, CT (US); Todd C. Zimmer, Meriden, CT (US)

(73) Assignee: Sargent Manufacturing Company, New Haven, CT (US)

( * ) Notice: Subject to any disclaimer, the term of this patent is extended or adjusted under 35 U.S.C. 154(b) by 0 days.

(21) Appl. No.: 10/628,922

(22) Filed: Jul. 29, 2003

(65) Prior Publication Data

US 2005/0023846 A1 Feb. 3, 2005

(51) Int. Cl.[7] ..... E05B 15/02
(52) U.S. Cl. ..... 292/357; 292/DIG. 61
(58) Field of Search ..... 292/336.3, 357, 292/DIG. 61, 337

(56) References Cited

U.S. PATENT DOCUMENTS

| | | | | |
|---|---|---|---|---|
| 2,119,866 A | | 6/1938 | Milligan | |
| 2,729,485 A | | 1/1956 | Schlage | |
| 2,801,869 A | | 8/1957 | George | |
| 2,899,228 A | * | 8/1959 | Polchinski | 292/169.18 |
| 3,207,541 A | | 9/1965 | Barlett | |
| 3,212,806 A | | 10/1965 | Russell et al. | |
| 3,708,191 A | * | 1/1973 | Hegedus | 292/1 |
| 4,671,089 A | | 6/1987 | Fleming et al. | |
| 4,869,083 A | | 9/1989 | DeMarseilles et al. | |
| 4,911,489 A | | 3/1990 | Hansen et al. | |
| 4,998,760 A | | 3/1991 | Nixon et al. | |
| 5,265,924 A | | 11/1993 | Kim | |
| 5,481,890 A | | 1/1996 | Millman | |
| 5,718,468 A | | 2/1998 | Qureshi et al. | |
| 5,727,406 A | | 3/1998 | Banducci | |
| 6,101,856 A | | 8/2000 | Pelletier et al. | |

FOREIGN PATENT DOCUMENTS

| | | | |
|---|---|---|---|
| EP | 0 526 409 | * | 2/1993 |
| GB | 480364 | * | 2/1938 |
| TW | 258270 | | 9/1995 |

* cited by examiner

*Primary Examiner*—Gary Estremsky
(74) *Attorney, Agent, or Firm*—DeLio & Peterson, LLC

(57) ABSTRACT

A lever handle return spring assembly for a cylindrical lock mounted in a bored opening in a door includes support plates on opposite sides of the door. The support plates include cylindrically depressed inner regions that extend partially into the bored opening in the door to accommodate return springs and reduce the visual thickness of the return spring assembly. Spring housings containing compression springs turn within the support plate inner regions and are held in place by cover plates. The support plate, cover plate, spring housing and springs on each side of the door form complete assemblies that are attached to the door via through-bolts. At least one of the support plates preferably includes lock tabs that connect to the cylindrical lock to prevent rotation of the cylindrical lock relative to the door. The support plate and cover plate are designed for strength when stamped from a flat sheet.

20 Claims, 2 Drawing Sheets

LEVER HANDLE RETURN SPRING ASSEMBLY

BACKGROUND OF THE INVENTION

1. Field of the Invention

The present invention relates to spring mechanisms used with cylindrical locks to support a lever handle in a horizontal orientation and to return the lever handle to horizontal after the handle is rotated.

2. Description of Related Art

Cylindrical locks include inner and outer handles mounted on corresponding spindles that extend outward from opposite sides of a central lock core mounted within a bored opening in a door. In designs intended for use with conventional round doorknobs, the lock core will typically include a spring return mechanism capable of returning a doorknob to its initial position after it is rotated.

However, when lever handles are installed, the spring return mechanism within the lock core is normally supplemented with lever handle return springs that are capable of supporting the lever handles and returning the handles to their initial horizontal orientation. Unlike a cylindrically symmetrical doorknob, the center of gravity of a lever handle is offset from its axis of rotation. This offset constantly applies a gravitational torque to the lever handle due to the weight of the lever portion of the handle. The gravitational torque must be overcome by the lever handle spring return mechanism when returning the handle to horizontal.

Conventionally, the lever handle return springs are mounted on the outer surface of the door in a rose surrounding the base of the handle. This produces a relatively thick and bulky undesirable appearance for the rose. A thinner appearance for the rose is preferred than is presently available.

The rose also preferably provides a stop for the rotation of the lever handle. In order to perform this function, and to provide the thickness required to hold the springs within the rose, the main structural base of the rose has heretofore been formed by casting, or by machining it from a relatively thick initial block of material. Producing the rose in this way is expensive. A less expensive method of construction for the principal structural elements of the rose is desirable that still retains the strength required in a lever handle design.

A further difficulty with existing lever handle return spring mechanisms relates to the clearances required, which can provide an undesirably "loose" feel to the mechanism. Reductions in the clearances to provide an improved feel are difficult in existing designs without unduly increasing cost.

Bearing in mind the problems and deficiencies of the prior art, it is therefore an object of the present invention to provide a lever handle return spring assembly that has a reduced visual thickness.

It is another object of the present invention to provide a lever handle return spring assembly that is strong and resistant to lever handle abuse and yet may be constructed at reduced cost compared to earlier designs.

A further object of the invention is to provide a lever handle return spring assembly that has an improved "smooth" feel by reducing friction.

It is yet another object of the present invention to provide a lever handle return spring assembly that has an improved "tight" feel by reducing internal clearances.

Still other objects and advantages of the invention will in part be obvious and will in part be apparent from the specification.

SUMMARY OF THE INVENTION

The above and other objects, which will be apparent to those skilled in art, are achieved in the present invention which is directed to a lever handle return spring assembly for a cylindrical lock of the type adapted for installation in a bored opening in a door. The lever handle return spring assembly includes a support plate, a cover plate, a spring housing located between the support plate and the cover plate and a pair of compression springs held in channels in the spring housing.

The support plate includes an outer region that contacts a face of the door and an inner region that is approximately cylindrical and is depressed relative to the surrounding surface of the outer region. The outer region has a diameter greater than the diameter of the bored opening in the door and includes at least one bolt hole for bolting the support plate to the door. The inner region has a diameter less than the diameter of the bored opening in the door such that it extends at least partially into the bored opening in the door when the support plate is installed. The inner region also includes at least one spring stop tab extending axially away from the inner region.

The spring housing has a diameter less than the diameter of the inner region of the support plate such that it extends at least partially into the cylindrically depressed inner region of the support plate. The spring housing is designed to be driven either directly or indirectly by a lever handle and the springs in the spring housing act to return the lever handle to the starting orientation after the handle is rotated.

A pair of annular spring channels in the spring housing corresponds to and receives the pair of compression springs in them. The spring channels open towards the inner region of the support plate and hold the pair of compression springs between the spring housing, the support plate and ends of the spring channels. The ends of the spring channels are connected together by at least one slot sized to allow the spring stop tab on the support plate to pass between the spring channels. As the spring housing is alternately rotated in opposite directions relative to the support plate, the spring stop tab moves through the slot between the spring channels and alternately compresses the compression springs. The spring housing is also provided with at least one radially projecting stop lug.

The cover plate includes an outer region connected to the outer region of the support plate and an inner region forming a cover to retain the spring housing and the compression springs in the cylindrically depressed inner region of the support plate. The outer region of the cover plate has at least one bolt hole for alignment with the bolt hole in the outer region of the support plate. At least one stop extends from the cover plate towards the support plate. The stop on the cover plate contacts the stop lug on the spring housing to limit rotation of the spring housing. At least one through-bolt extends through the bolt holes in the cover plate and support plate to prevent rotation of the return spring assembly relative to the door.

In the preferred design, there are lever handle return spring assemblies on each side of the door. On one side the inner region of the support plate is internally threaded onto the cylindrical lock. On the other side, the support plate is provided with at least one lock tab that engages the cylindrical lock to prevent rotation of the cylindrical lock relative to the door and the support plate. In the most highly preferred embodiment of the invention, the support plate includes a pair of oppositely positioned lock tabs that engage the cylindrical lock on opposite sides thereof.

The lever handle return spring assembly is particularly designed so that key components, such as the support plate and cover plate may be made from an initially flat sheet material, such as sheet steel, using a stamping process. The spring stop tab and the stop extending from the cover plate may be made during the stamping process. The stop extending from the cover plate is preferably formed by stamping a portion of the cover plate between two opposed slots in an outer perimeter of the inner region of the cover plate such that the stop extends from the cover plate towards the support plate and into interfering engagement with the stop lug on the spring housing.

Another aspect of the invention is the use of a friction bushing, preferably made of a self-lubricating polymer. In the preferred design, a spacer bushing extends through a central opening in the cover plate and engages the spring housing on one side of the cover plate and a lever handle on an opposite side of the cover plate. The friction bushing is positioned around the spacer bushing and acts as a radial bearing between the spacer bushing and the cover plate. The friction bushing is provided with an annular surface positioned between the spring housing and the cover plate, providing an axial thrust bearing therebetween.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

In describing the preferred embodiment of the present invention, reference will be made herein to FIGS. 1–4 of the drawings in which like numerals refer to like features of the invention.

Figure 1:
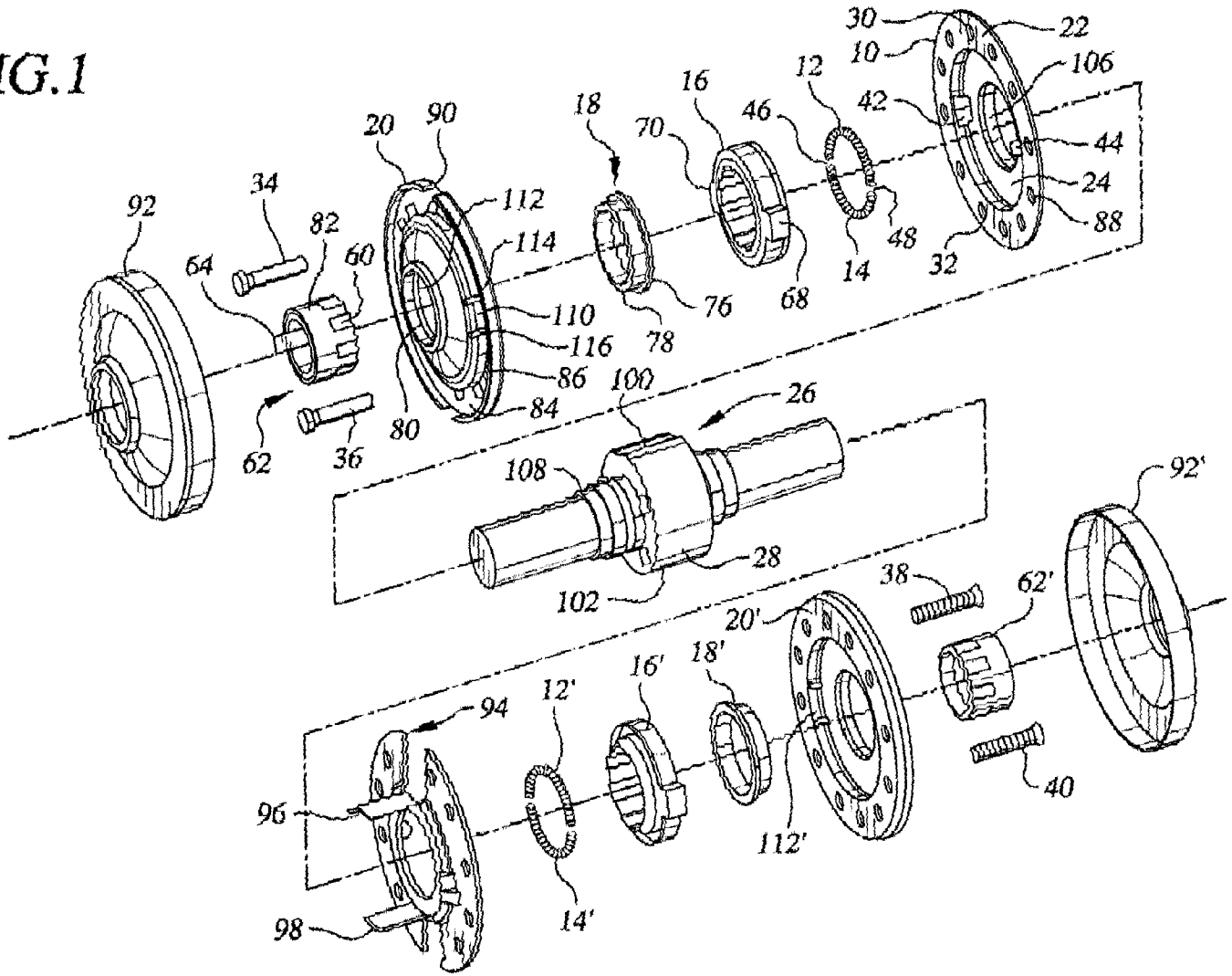
FIG. 1 is an exploded perspective view of a lever handle return spring assembly for a cylindrical lock according to the present invention.

Referring to FIG. 1, the lever handle return spring assembly of the present invention includes a support plate 10, a pair of compression springs 12, 14, a spring housing 16, a friction bushing 18, and a cover plate 20 all integrated into a module mounted to the exterior surface of a door around the spindle of a cylindrical lock 26.

The support plate 10 includes an outer region 22 and an inner region 24, both of which are approximately annular in shape and surround a central opening in the support plate through which a spindle of the lock 26 projects to engage a lever handle. The outer region 22 is attached to the outer surface of a door receiving the cylindrical lock 26 and surrounds the bored opening in the door within which the lock core 28 is mounted.

The inner region in 24 of the support plate 10 is cylindrically depressed relative to the plane of the outer region and the plane of the door surface to which it is mounted. Thus, the inner region 24 of the support plate extends at least partially into the bored opening in the door that holds the lock core 28 when the outer region 22 of the support plate is mounted flush against the surface of the door.

At least one bolt hole, and preferably two oppositely located bolt holes 30, 32 are provided in the outer region of the support plate to receive through-bolts. The through bolts are formed as a studs half 34, 36 and a screw half 38, 40 which extend into the studs. The through-bolts pass through the outer region of the support plate 10 and into a corresponding through-hole drilled in the door.

A door prepared to receive a cylindrical lock of the type in FIG. 1 will typically include a bored opening that receives the lock core 28 and a pair of through-holes on opposite sides of thereof. The through-holes may be located vertically above and below the central bored opening or at a 45-degree angle thereto. Accordingly, the outer region of the support plate 10 is preferably provided with additional pairs of bolt holes corresponding to other conventional locations for through-holes in the door. The studs and screws may be repositioned in any of the available pairs of bolt holes in the outer region of the support plate to match the through holes available in the prepared door.

The diameter of the depressed inner region 24 of the support plate 10 is less than the diameter of the bored opening in the door to allow the outer region 22 to be bolted flush to the outer surface of the door while the inner region 24 extends at least partially into the bored opening. This allows a portion of the return spring assembly of the invention to extend into the bored opening in the door and thereby reduces the apparent visual thickness of the rose to improve the appearance of the lock.

The inner region 24 is provided with at least one, and preferably two opposed spring stop tabs 42 and 44 that extend axially away from the inner region 24. The spring stop tabs 42, 44 extend into gaps 46, 48 between the compression springs 12, 14. Gaps 46, 48 correspond to slots 54, 56 in the spring housing 16 seen in greater detail in FIGS. 2–4.

Figure 2:
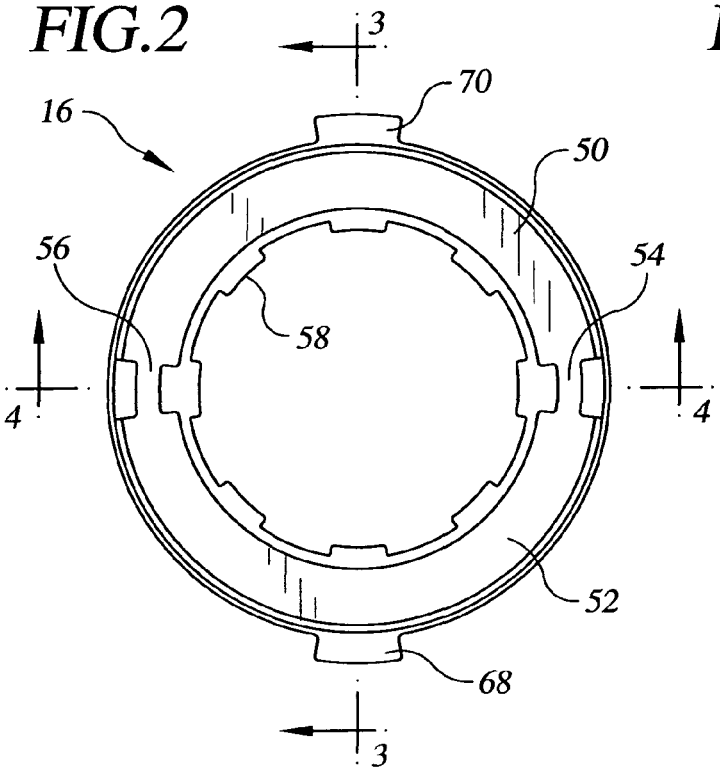
FIG. 2 is a front view of the spring housing in FIG. 1.
Figure 3:
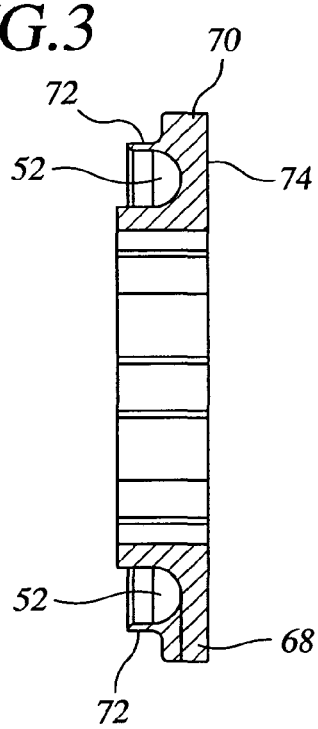
FIG. 3 is a cross-sectional view of the spring housing in FIG. 2, taken along the line 3—3 in FIG. 2.
Figure 4:
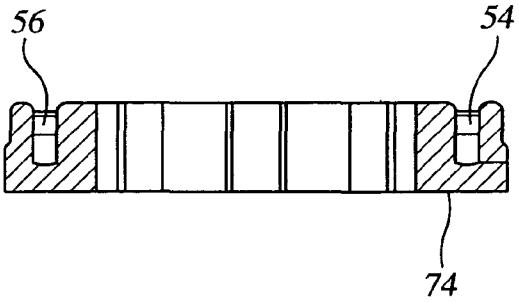
FIG. 4 is a is a cross-sectional view of the spring housing in FIG. 2, taken along the line 4—4 in FIG. 2.

Referring to FIGS. 2–4, the side of the spring housing 16 facing the support plate 10 includes a pair of spring channels 50, 52 that hold the compression springs 12, 14. The ends of the spring channels are connected together by slots 54, 56 which are sized to allow the spring stop tabs 42, 44 to pass through, but not the ends of the compression springs.

The spring housing 16 is generally ring-shaped with its central opening being provided with splines 58 that engage corresponding spline channels 60 on spacer bushing 62. The spacer bushing 62 extends through the central opening in cover plate 20 and through friction bushing 18 into engagement with the splines on the spring housing. The spacer bushing 62 includes a tab 64 that engages the lever handle such that as the lever handle is rotated it turns the spacer bushing 62, which drives the spring housing 16 and thereby rotates the compression springs 12, 14 with the spring housing.

The spring stop tabs 42, 44 remain stationary with the support plate 10 which is bolted to the door. The rotation of the spring housing 16 in either direction causes both of the compression springs to be compressed simultaneously between an end of their spring channel and a corresponding spring stop tab 42, 44. When the spring housing is rotated by a lever handle in a first direction, spring stop tab 42 will compress spring 12. When the handle is turned in the opposite direction spring stop tab 42 will compress spring 14.

Referring to FIGS. 2 and 3, it can be seen that the spring housing 16 is provided with at least one and preferably two opposed stop lugs 68, 70 that radially out from the exterior surface of the spring housing. The stop lugs 68, 70 have an axial thickness that is less than the axial thickness of the rest of the spring housing (see FIG. 3). This allows the spring housing 16 to extend partially into the depressed inner region 24 of the support plate 10, as previously described.

The back surface 74 of the spring housing 16 is smooth. This smooth surface faces the friction bearing 18 and provides a thrust surface for the friction bearing 18 to act against. Referring to FIG. 1, the friction bearing 18 includes an annular outer ring portion 76 that acts as a thrust bearing surface between surface 74 on the spring housing and a corresponding inner surface on the cover plate 20.

The friction bushing 18 also includes a cylindrical portion 78 that provides a bearing surface between an inner surface 80 of the cover plate 20 and an outer surface 82 of the spacer bushing 62. Thus, the friction bushing 18 performs both a radial bearing function and an axial bearing function. To perform these functions, the friction bushing 18 is preferably formed of a self-lubricating polymer material. By providing these bearings, the return spring assembly of the invention can be constructed with low clearances which provide an improved feel of quality to the lock mechanism it is attached to.

The support plate 10, springs 12, 14, spring housing 16, friction bushing 18 and the cover plate 20 comprise an integrated unit that is preferably pre-assembled at the factory. Rivets or other fasteners are used to connect an outer region 84 of the cover plate with the outer region of the support plate. The rivets extend through rivet holes 86 and 88 in the respective outer regions of the cover plate and support plate.

The outer region 84 of the cover plate is also provided with corresponding bolt holes 90 that align with bolt holes 30, 32 in the support plate 10 and allow the studs 34, 36 to extend through both the outer region of the cover plate and the outer region of the support plate and into corresponding through-holes in the door. After the lever return spring assembly is installed, it is covered with scalp 92 and a lever handle is installed.

The description above relates to the lever handle return spring assembly located above the cylindrical lock 26 in FIG. 1. This assembly is intended for installation on the outside surface of a door to be locked. A corresponding lever return spring assembly to be installed on the inside surface of the door to be locked is shown below the cylindrical lock mechanism 26 in FIG. 1. This provides spring return for lever handles located on both sides of the door.

All of the components located below the cylindrical lock mechanism 26 in FIG. 1 are identical to the corresponding components above lock assembly 26, with the exception of the support plate 94 and the substitution of screws 38 and 40 for the studs 34 and 36. Accordingly, each of the identical elements below the cylindrical lock 26 has been referred to with the same number used above except that a prime has been added to the reference number. Accordingly, the outside friction bushing is referred to as 18 and is located above the cylindrical lock 26 in FIG. 1. The identical inside friction bushing is referred to as 18' and is located below the cylindrical lock 26 in FIG. 1.

The inside support plate 94 differs from the outside support plate 10 principally with the addition of lock tabs 96 and 98 that extend axially into engagement with the lock core 28 at positions 100 and 102.

The outside support plate 10 is provided with an internally threaded central opening 106 that threads onto an externally threaded portion 108 on the cylindrical lock 26. The inside support plate 10 can be rotated on the threaded portion 108 to adjust for different door thicknesses. This rotation also allows the bolt holes in the return spring assembly to be rotationally aligned with the through-holes in the door.

Axial lock tabs 96 and 98 engage the lock core 28 at 100, 102 and prevent it from rotating relative to the support plates. The support plates are through-bolted to the door with through-bolts comprising screws 38, 40 and studs 34, 36. The result is improved resistance to rotation of the lock mechanism 26 when excess force is applied to the lever handles.

To protect the lock mechanism, such excess force is transferred directly from the lever handle to the door through the stop lugs 68 and 70 on the spring housing and stops 110 and 112 on the cover plate 20. The stop lugs 68 and 70 on the spring housing and the stops 110 and 112 on the cover plate 20 define a limited rotation angle for the spring housing and the lever handle attached to it.

As described above, the cover plate 20 holds the spring housing in the cylindrically depressed central region of the support plate 10. The central region of the cover plate is formed in the opposite direction to the depressed central region of the support plate so that the two opposed central regions of the support and cover plates define a chamber surrounding the spring housing 16. The stops 110 and 112 on the cover plate project into this chamber and limit rotation of the spring housing by providing obstructing contact with the stop lugs 68, 70.

The support plate 10 and the cover plate 20 are designed so that they may be made from an initially flat material, preferably sheet steel. This allows these components to be made by a relatively inexpensive stamping process while still allowing them to remain quite strong due to their design.

The spring stop tabs 42, 44 are simply bent axially out of the plane of the sheet material. The stops 110, 112 are made in the cover plate by punching two slots on opposite sides of each of the stops. Slots 114, 116 on opposite sides of stop 110 allow the sheet material between slots 114 and 116 to be stamped inward into the chamber formed between the support and cover plates to form stop 110. Similar slots on opposite sides of stops 112, 110' and 112' perform the same function.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A lever handle return spring assembly for a cylindrical lock of the type adapted for installation in a bored opening in a door, the lever handle return spring assembly comprising:

a support plate including:

an outer region for making supporting contact with a face of the door, the outer region having a diameter greater than a diameter of the bored opening in the door and at least one bolt hole located in the outer region; and an inner region having a diameter less than the diameter of the bored opening in the door, the inner region being cylindrically depressed relative to the outer region to extend at least partially into the bored opening in the door when the support plate is installed, the inner region including at least one spring stop tab extending axially away from the inner region;

a pair of compression springs;

a cylindrical spring housing having a diameter less than the diameter of the inner region of the support plate such that the spring housing extends at least partially into the cylindrically depressed inner region of the support plate, the spring housing being adapted to be driven by a lever handle and including:

a pair of annular spring channels corresponding to and receiving the pair of compression springs, the spring channels opening towards the inner region of the support plate to hold the springs between the spring housing, the support plate and ends of the spring channels, the spring channels being connected together by at least one slot sized to receive the at least one spring stop tab whereby the at least one spring stop tab passes between the spring channels to alternately compress the compression springs as the spring housing is alternately rotated in opposite directions relative to the support plate; and at least one stop lug radially projecting from the spring housing;

a cover plate including:

an outer region connected to the outer region of the support plate, the outer region of the cover plate having at least one bolt hole for alignment with the bolt hole in the outer region of the support plate; and an inner region forming a cover to retain the spring housing and the compression springs in the cylindrically depressed inner region of the support plate; and at least one stop extending from the cover plate towards the support plate, the at least one stop on the cover plate providing interfering engagement with the at least one stop lug on the spring housing to limit rotation of the spring housing; and at least one through-bolt extending through the bolt holes in the cover plate and support plate.

2. The lever handle return spring assembly for a cylindrical lock according to claim 1 wherein the inner region of the support plate is internally threaded for threaded engagement with the cylindrical lock.

3. The lever handle return spring assembly for a cylindrical lock according to claim 1 wherein the support plate includes at least one lock tab for engaging the cylindrical lock to prevent rotation of the cylindrical lock relative to the support plate.

4. The lever handle return spring assembly for a cylindrical lock according to claim 3 wherein the support plate includes a second lock tab opposite the at least one lock tab for engaging the cylindrical lock on opposite sides thereof to prevent rotation of the cylindrical lock relative to the support plate.

5. The lever handle return spring assembly for a cylindrical lock according to claim 1 wherein the support plate is formed from an initially flat sheet material.

6. The lever handle return spring assembly for a cylindrical lock according to claim 5 wherein the support plate is formed by stamping and the initially flat sheet material is steel.

7. The lever handle return spring assembly for a cylindrical lock according to claim 6 wherein the at least one stop extending from the cover plate is formed by stamping a portion of the cover plate between two opposed slots in an outer perimeter of the inner region of the cover plate such that the at least one stop extends from the cover plate towards the support plate and into interfering engagement with the at least one stop lug on the spring housing.

8. The lever handle return spring assembly for a cylindrical lock according to claim 1 wherein the cover plate is formed from an initially flat sheet material.

9. The lever handle return spring assembly for a cylindrical lock according to claim 8 wherein the cover plate is formed by stamping and the initially flat sheet material is steel.

10. The lever handle return spring assembly for a cylindrical lock according to claim 1 wherein the support plate is riveted to the support plate.

11. The lever handle return spring assembly for a cylindrical lock according to claim 1 further including:

a spacer bushing extending through a central opening in the cover plate, the spacer bushing engaging the spring housing on one side of the cover plate and a lever handle on an opposite side of the cover plate; and a friction bushing positioned around the spacer bushing.

12. The lever handle return spring assembly for a cylindrical lock according to claim 11 wherein the friction bushing includes a cylindrical surface positioned between the spacer bushing and the cover plate and an annular surface positioned between the spring housing and the cover plate, the cylindrical surface providing a radial bearing between the spacer bushing and the cover plate and the annular surface providing an axial thrust bearing between the spring housing and the cover plate.

13. The lever handle return spring assembly for a cylindrical lock according to claim 12 wherein the friction bushing is made of a self-lubricating polymer.

14. The lever handle return spring assembly for a cylindrical lock according to claim 1 wherein the bolt holes in the cover plate and support plate align with a corresponding through-hole in the door, the at least one through-bolt extending through the bolt holes in the cover plate, support plate and the through-hole in the door.

15. The lever handle return spring assembly for a cylindrical lock according to claim 14 wherein the at least one through-bolt extends through the bolt holes in the cover plate, support plate and the through-hole in the door and engages a corresponding stud.

16. A lever handle return spring assembly for a cylindrical lock of the type adapted for installation in a bored opening in a door, the lever handle return spring assembly comprising:

a first support plate including:

an outer region for making supporting contact with a first face of the door, the outer region having a diameter greater than a diameter of the bored opening in the door and at least two bolt holes located in the outer region for alignment with corresponding through-holes in the door located radially outside the bored opening in the door; and an inner region having a diameter less than the diameter of the bored opening in the door, the inner region being cylindrically depressed relative to the outer region to extend at least partially into the bored opening in the door when the first support plate is installed, the inner region including a first pair of spring stop tabs extending axially away from the inner region and having a central threaded opening for threaded engagement with the cylindrical lock;

a first pair of compression springs;

a first cylindrical spring housing having a diameter less than the diameter of the inner region of the support plate such that the first spring housing extends at least partially into the cylindrically depressed inner region of the first support plate, the first spring housing being adapted to be driven by a first lever handle and including:

a first pair of annular spring channels corresponding to and receiving the first pair of compression springs, the first spring channels opening towards the inner region of the first support plate to hold the first pair of compression springs between the first spring housing, the first support plate and ends of the first pair of spring channels, the first pair of spring channels being connected together at opposite ends by slots sized to receive the first pair of spring stop tabs whereby the first pair of spring stop tabs pass between the first pair of spring channels to alternately compress the first pair of compression springs as the first spring housing is alternately rotated in opposite directions relative to the first support plate; and a first pair of stop lugs radially projecting from the first spring housing;

a first cover plate including:

an outer region connected to the outer region of the first support plate, the outer region of the first cover plate having at least two bolt holes for alignment with the at least two bolt holes in the outer region of the first support plate and the through-holes in the door; and an inner region forming a cover to retain the first spring housing and the first pair of compression springs in the cylindrically depressed inner region of the first support plate; and a first pair of stops extending from the cover plate towards the support plate, the first pair of stops on the cover plate providing interfering engagement with the first pair of stop lugs on the spring housing to limit rotation of the spring housing;

a second support plate having a pair of lock tabs for engaging the cylindrical lock to prevent rotation of the cylindrical lock relative to the second support plate, the second support plate including:

an outer region for making supporting contact with a second face of the door, the outer region having a diameter greater than a diameter of the bored opening in the door and at least two bolt holes located in the outer region for alignment with the bolt holes in the first support plate; and an inner region having a diameter less than the diameter of the bored opening in the door, the inner region being cylindrically depressed relative to the outer region to extend at least partially into the bored opening in the door when the second support plate is installed, the inner region including a second pair of spring stop tabs extending axially away from the inner region;

a second pair of compression springs;

a second cylindrical spring housing having a diameter less than the diameter of the inner region of the support plate such that the second spring housing extends at least partially into the cylindrically depressed inner region of the second support plate, the second spring housing being adapted to be driven by a second lever handle and including:

a second pair of annular spring channels corresponding to and receiving the second pair of compression springs, the second spring channels opening towards the inner region of the second support plate to hold the second pair of compression springs between the second spring housing, the second support plate and ends of the second pair of spring channels, the second pair of spring channels being connected together at opposite ends by slots sized to receive the second pair of spring stop tabs whereby the second pair of spring stop tabs pass between the second pair of spring channels to alternately compress the second pair of compression springs as the second spring housing is alternately rotated in opposite directions relative to the second support plate; and a second pair of stop lugs radially projecting from the second spring housing;

a second cover plate including:

an outer region connected to the outer region of the second support plate, the outer region of the second cover plate having at least two bolt holes for alignment with the at least two bolt holes in the outer region of the second support plate and the through-holes in the door; and an inner region forming a cover to retain the second spring housing and the second pair of compression springs in the cylindrically depressed inner region of the second support plate; and a second pair of stops extending from the cover plate towards the support plate, the second pair of stops on the cover plate providing interfering engagement with the second pair of stop lugs on the spring housing to limit rotation of the spring housing;

at least one through-bolt extending through the bolt holes in the cover plate and support plate and into the through-hole in the door.

17. The lever handle return spring assembly for a cylindrical lock according to claim 16 wherein the first and second support plates and the first and second cover plates are formed from initially flat sheet materials.

18. The lever handle return spring assembly for a cylindrical lock according to claim 17 wherein the first and second support plates and the first and second cover plates are formed by stamping and the initially flat sheet materials are steel.

19. The lever handle return spring assembly for a cylindrical lock according to claim 16 further including:

a first spacer bushing extending through a central opening in the first cover plate, the first spacer bushing engaging the first spring housing on one side of the first cover plate and a first lever handle on an opposite side of the first cover plate;

a first friction bushing positioned around the first spacer bushing;

a second spacer bushing extending through a central opening in the second cover plate, the second spacer bushing engaging the second spring housing on one side of the second cover plate and a second lever handle on an opposite side of the second cover plate; and a second friction bushing positioned around the second spacer bushing.

20. The lever handle return spring assembly for a cylindrical lock according to claim 16 further including first and second friction bushings constructed of a self-lubricating polymer, the first and second friction bushings having respective first and second cylindrical surfaces contacting the first and second cover plates, the first and second cylindrical surfaces acting as radial bearings to reduce clearance in a radial direction, the first and second friction bushings also having respective first and second annular surfaces contacting the first and second cover plates, the first and second annular surfaces acting as corresponding first and second axial thrust bearings to reduce clearance in an axial direction.

* * * * *